US005474009A

United States Patent [19]

Ritchie et al.

[11] Patent Number: 5,474,009

[45] Date of Patent: Dec. 12, 1995

[54] PONTOON DEVICE WITH MECHANISMS FOR VARYING THE WIDTH

[76] Inventors: Buddy L. Ritchie; Terri L. Ritchie, both of P.O. Box 95, Combs, Ark. 72721

[21] Appl. No.: 293,893

[22] Filed: Aug. 22, 1994

[51] Int. Cl.[6] ..... B63B 1/00

[52] U.S. Cl. ..... 114/61

[58] Field of Search ..... 114/61, 353, 354, 114/77 R, 123, 77 A

[56] References Cited

U.S. PATENT DOCUMENTS 3,045,263 7/1962 Blachly ..... 114/61
3,114,157 12/1963 Stockmann ..... 114/61
3,925,837 12/1975 Miller ..... 114/61
3,981,259 9/1976 Harper, Jr. ..... 114/123

*Primary Examiner*—Jesus D. Sotelo

[57] ABSTRACT

A pontoon device with mechanisms for varying the width comprising a floor having parallel side edges and front and rear edges; pontoons positionable with respect to the floor with the axes of the pontoons parallel with the side edges of the floor and located beneath the opposite edges thereof; and adjustment mechanisms to vary the lateral spacing between the pontoons, such adjustment mechanisms including a plurality of rod assemblies secured at their opposite ends to the pontoons beneath the lower surface of the floor, each rod assembly including a pair small linear ribs in axial alignment with their outboard ends secured to a pontoon and with an enlarged tubular member therebetween receiving the inboard ends of the ribs in sliding relationship therewith.

1 Claim, 4 Drawing Sheets

PONTOON DEVICE WITH MECHANISMS FOR VARYING THE WIDTH

BACKGROUND OF THE INVENTION

1. Field of the Invention

The present invention relates to pontoon device with mechanisms for varying the width and more particularly pertains to varying the width of a pontoon through laterally extensible internal mechanisms.

2. Description of the Prior Art

The use of floatation devices with pontoons is known in the prior art. More specifically, floatation devices with pontoons heretofore devised and utilized for the purpose of providing a floating device with pontoons capable of various constructions and configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,829,926 to Voelkel a pontoon boat having a collapsible form.

U.S. Pat. No. 4,766,830 to Kunz discloses a boat, especially a catamaran, with large deck space and collapsible frame.

U.S. Pat. No. 4,730,570 to Harris discloses a variable beam trimaran.

U.S. Pat. No. 4,040,134 to Downing discloses a pontoon boat.

U.S. Pat. No. 3,763,511 to Sisil discloses a foldable and trailerable pontoon boat.

In this respect, the pontoon device with mechanisms for varying the width according to the present invention substantially departs from the conventional concepts and designs of the prior art, and in doing so provides an apparatus primarily developed for the purpose of varying the width of a pontoon through laterally extensible internal mechanisms.

Therefore, it can be appreciated that there exists a continuing need for new and improved pontoon device with mechanisms for varying the width which can be used for varying the width of a pontoon through laterally extensible internal mechanisms. In this regard, the present invention substantially fulfills this need.

SUMMARY OF THE INVENTION

In view of the foregoing disadvantages inherent in the known types of floatation devices with pontoons now present in the prior art, the present invention provides an improved pontoon device with mechanisms for varying the width. As such, the general purpose of the present invention, which will be described subsequently in greater detail, is to provide a new and improved pontoon device with mechanisms for varying the width and method which has all the advantages of the prior art and none of the disadvantages.

To attain this, the present invention essentially comprises a new and improved pontoon device with mechanisms for varying the width comprising, in combination, a floor having parallel side edges and front and rear edges, the floor being split along a center line into two similar sections along a line between the side edges with hinges pivotally coupling the sections; pontoons positionable with respect to the floor with the axes of the pontoons parallel with the side edges of the floor and located beneath the opposite edges thereof; a handrail extending upwardly from the upper surface of the floor parallel with the pontoons and side edges and located thereabove; adjustment mechanisms to vary the lateral spacing between the pontoons, such adjustment mechanisms including a plurality of rod assemblies secured at their opposite ends to the pontoons beneath the lower surface of the floor, each rod assembly including a pair small linear ribs in axial alignment with their outboard ends secured to a pontoon and with an enlarged tubular member therebetween receiving the inboard ends of the ribs in sliding relationship therewith; quick release pins extendable through apertures in the ribs and adjustment sleeve to lock the ribs with respect to the adjustment sleeve in a predetermined orientation to define the spacing between the pontoons; drive means for automatically moving the ribs into and out of the adjustment sleeve, such adjustment mechanisms including a jack screw with oppositely disposed threads on each side of the midpoint cooperable with threaded apertures at the inboard end of the ribs, whereby rotation of the jack screw in one direction will retract the ribs to reduce the spacing between the pontoons by about 50 percent while rotation in the other direction will act to expand the spacing between the pontoons to about 100 percent, the drive means also including a motor coupled to the adjustment sleeve with bevel gears operable to automatically rotate the jack screw in one direction and the other; and a stop member on the outboard end of the jack screw cooperable with an abutment surface interior of the ribs to limit the inboard motion of the ribs.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pontoon device with mechanisms for varying the width which have all the advantages of the prior art floatation devices with pontoons and none of the disadvantages.

It is another object of the present invention to provide a new and improved pontoon device with mechanisms for varying the width which may be easily and efficiently manufactured and marketed.

It is further object of the present invention to provide a new and improved pontoon device with mechanisms for varying the width which are of durable and reliable constructions.

An even further object of the present invention is to provide a new and improved pontoon device with mechanisms for varying the width which are susceptible of a low cost of manufacture with regard to both materials and labor, and which accordingly are then susceptible of low prices of sale to the consuming public, thereby making such pontoon device with mechanisms for varying the width economically available to the buying public.

Still yet another object of the present invention is to provide a new and improved pontoon device with mechanisms for varying the width which provide in the apparatuses and methods of the prior art some of the advantages thereof, while simultaneously overcoming some of the disadvantages normally associated therewith.

Still another object of the present invention is to vary the width of a pontoon through laterally extensible internal mechanisms.

Lastly, it is an object of the present invention to provide new and improved pontoon device with mechanisms for varying the width comprising a floor having parallel side edges and front and rear edges; pontoons positionable with respect to the floor with the axes of the pontoons parallel with the side edges of the floor and located beneath the opposite edges thereof; and adjustment mechanisms to vary the lateral spacing between the pontoons, such adjustment mechanisms including a plurality of rod assemblies secured at their opposite ends to the pontoons beneath the lower surface of the floor, each rod assembly including a pair small linear ribs in axial alignment with their outboard ends secured to a pontoon and with an enlarged tubular member therebetween receiving the inboard ends of the ribs in sliding relationship therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
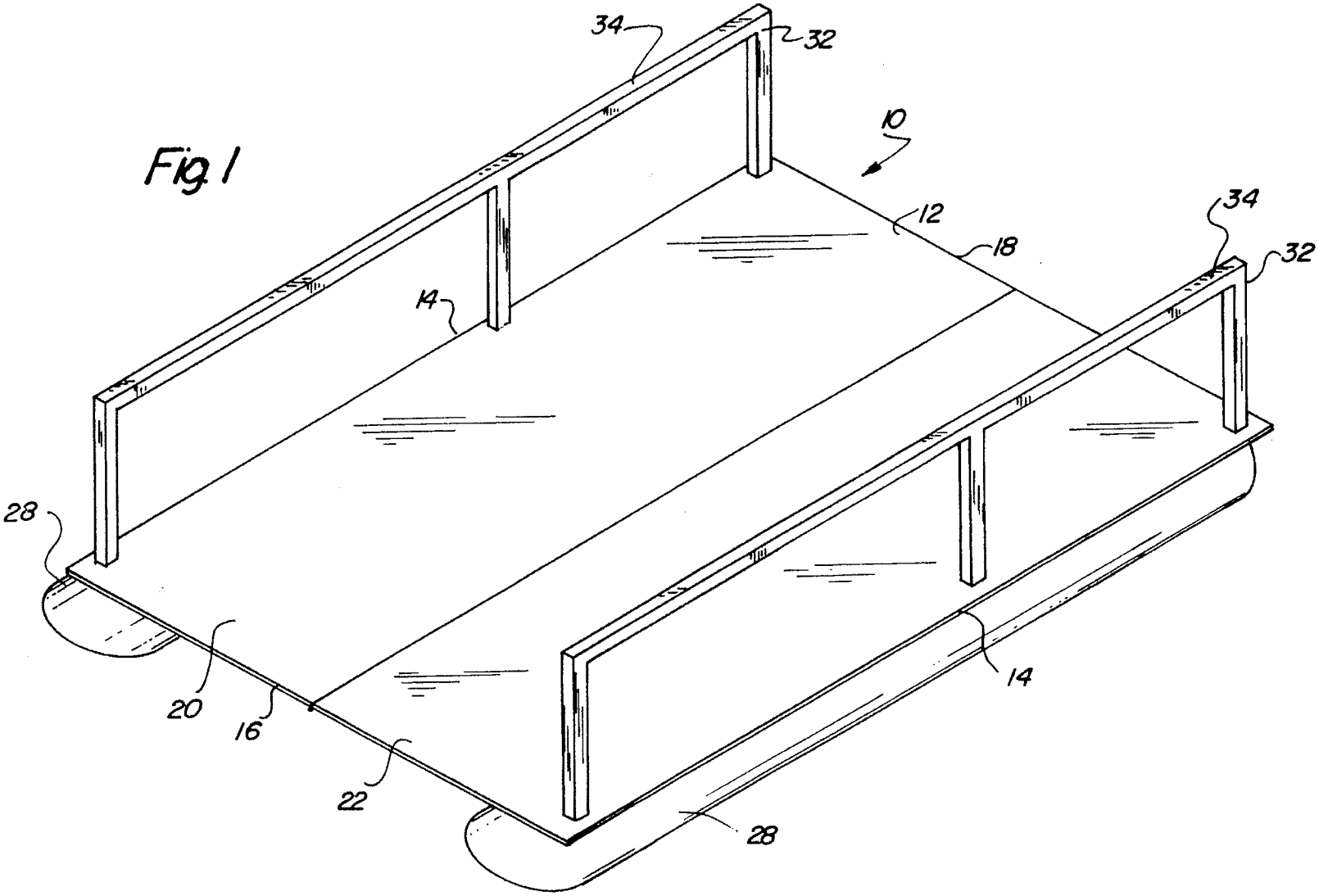
FIG. 1 is a perspective view of the preferred embodiment of the pontoon device with mechanisms for varying the width constructed in accordance with the principles of the present invention.
Figure 2:
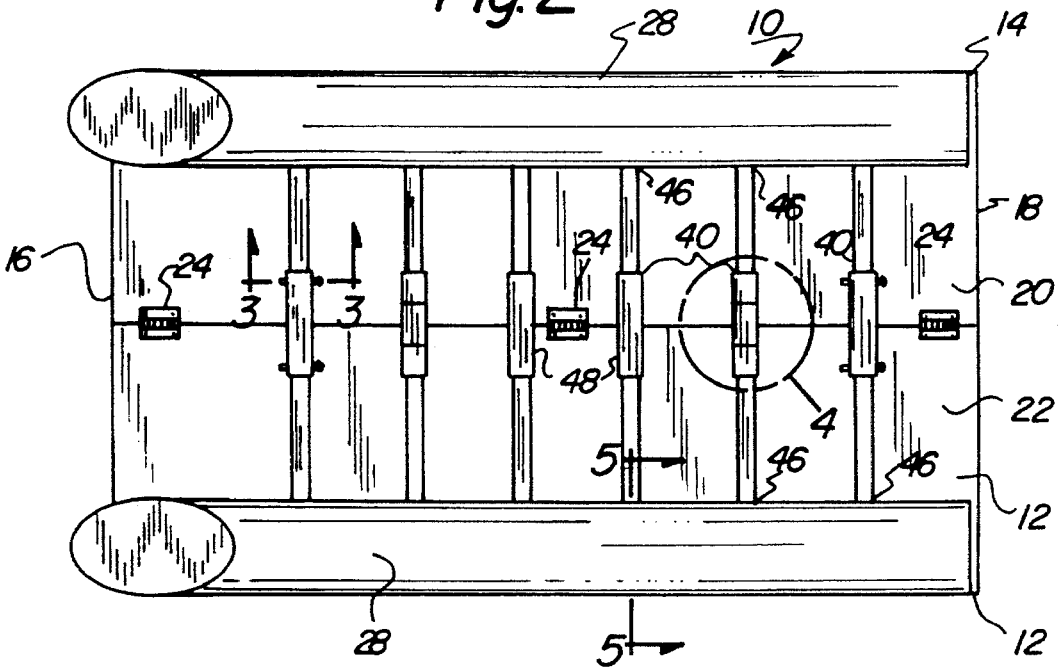
FIG. 2 is a bottom view of the pontoon device illustrated in FIG. 1.
Figure 3:
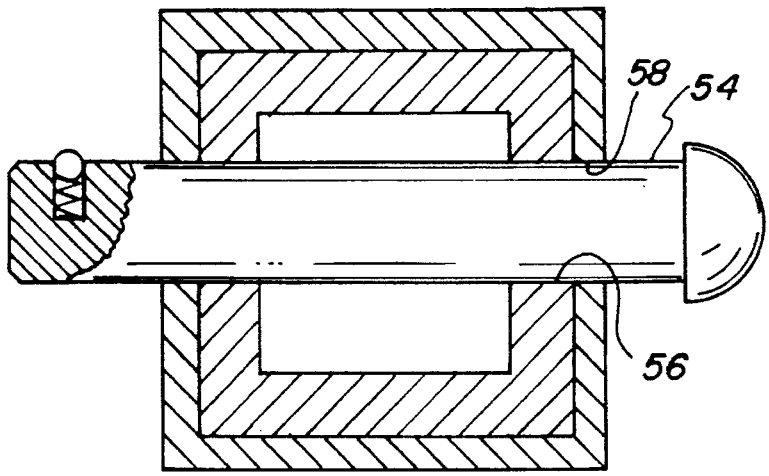
FIG. 3 is a cross sectional view of a portion of the device taken along line 3—3 of FIG. 2.
Figure 4:
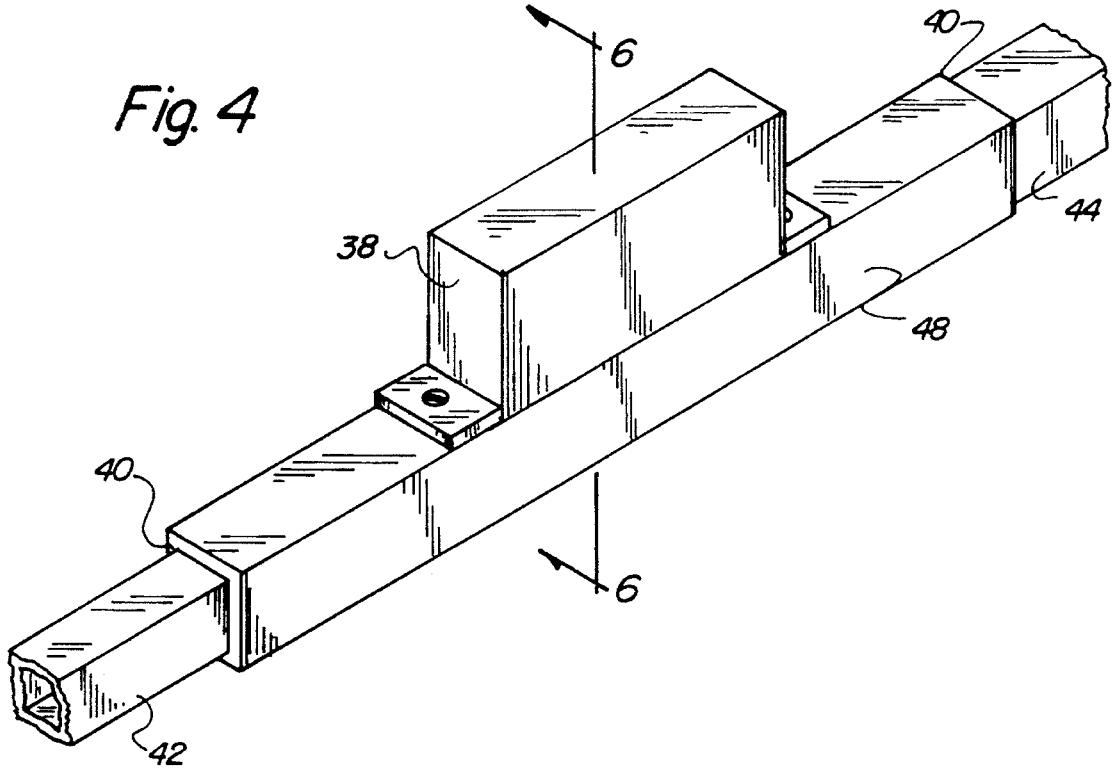
FIG. 4 is a perspective illustration of a portion of the device of the prior Figures taken about circle 4 of FIG. 2.
Figure 5:
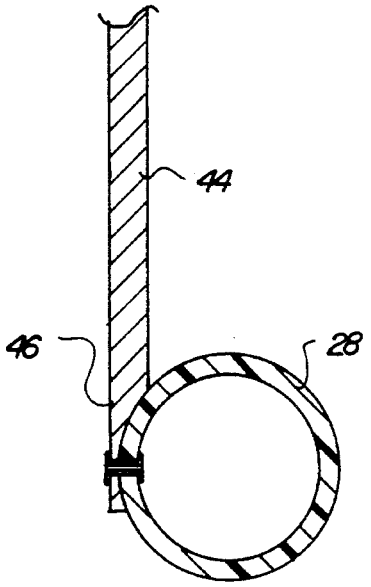
FIG. 5 is a cross sectional view of a pontoon and an associated adjustment rib taken along line 5—5 of FIG. 2.
Figure 6:
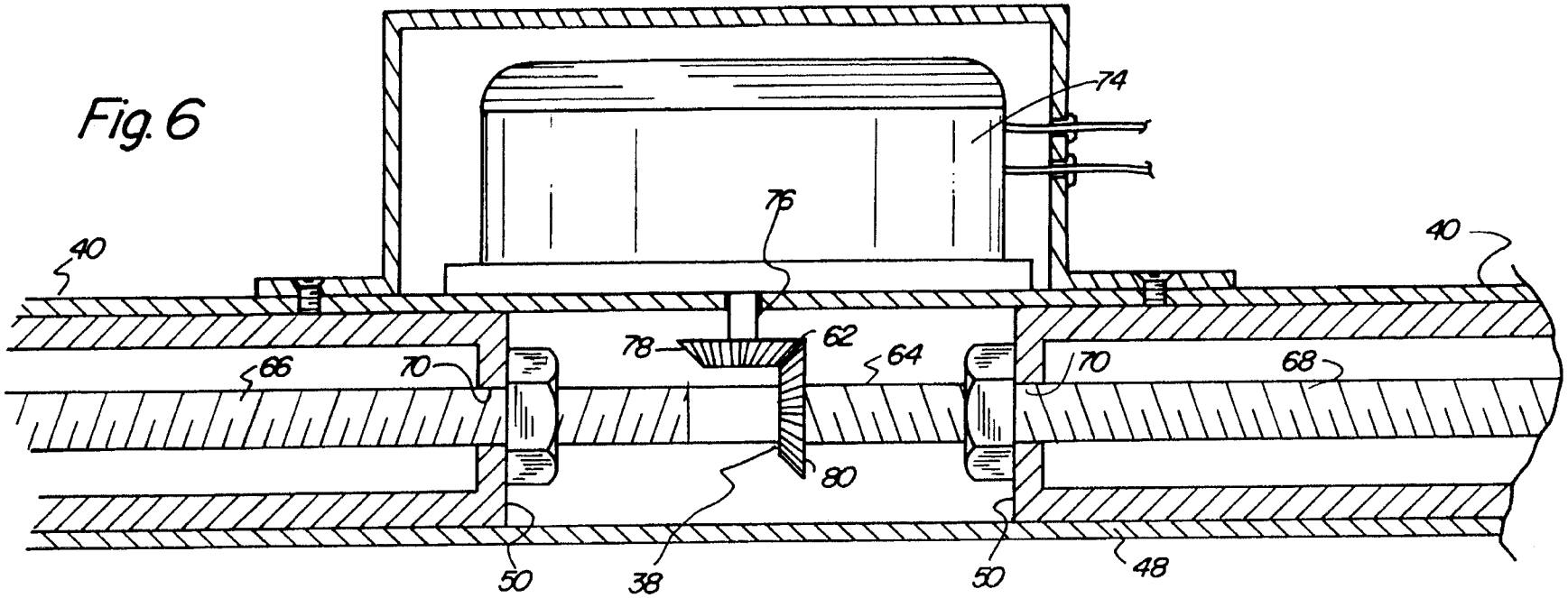
FIG. 6 is a cross sectional view of the drive mechanisms taken along line 6—6 of FIG. 4.
Figure 7:
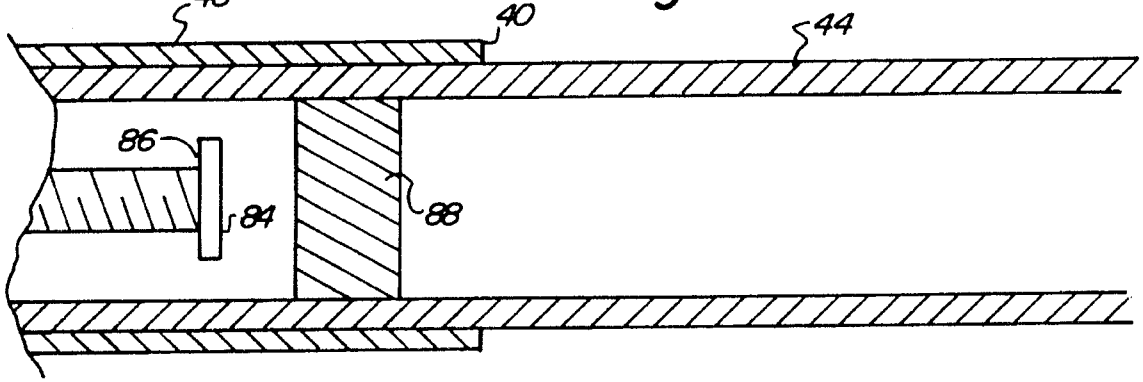
FIG. 7 is an enlarged cross sectional view of the right end of the device shown in FIG. 6.

With reference now to the drawings, and in particular to FIG. 1 thereof, the preferred embodiment of the new and improved pontoon device with mechanisms for varying the width embodying the principles and concepts of the present invention and generally designated by the reference numeral 10 will be described.

The present invention, the new and improved pontoon device with mechanisms for varying the width is a system 10 comprised of a plurality of components. Such components, in their broadest context, include a floor, pontoons, a handrail, adjustment mechanisms, quick release pins, drive means, and stop members. Such components are individually configured and correlated with respect to each other so as to attain the desired objectives.

More specifically, the device of the present invention is a system 10. It has as a basic component a floor 12. The floor has parallel side edges 14, and front and rear edges 16 and 18. The floor is split along a center line into two similar sections 20 and 22. Such split is along a line centrally located between the side edges. Hinges 24 pivotally couple the sections. When fully expanded, the floor is of a single thickness and is of a larged size. When the pontoons are drawn together, as will be later described, the floor may be folded in half to provide for a floor surface of a double thickness but half the size.

Located beneath the floor are a pair of pontoons 28. The pontoons are positionable with respect to the floor with the axes of the pontoons parallel with the side edges of the floor. The pontoons are located beneath the floor beneath the opposite edges thereof.

Security is provided to the floor during operation and use through a pair of hand rails 32. The hand rails are in an inverted U-shaped configuration. They extend upwardly from the upper surface of the floor. Their upper surfaces 34 are parallel with the pontoons and side edges. The hand rails are located thereabove.

Next provided are adjustment mechanisms 38 for the pontoons. Such adjustment mechanisms function to vary the lateral spacing between the pontoons. The adjustment mechanisms include a plurality of rod assemblies 40. Each rod assembly is secured at its opposite ends to the pontoons beneath the lower surface of the floor. Each rod assembly includes a pair of smaller linear ribs 42 and 44. Such ribs are in axial alignment. Their outboard ends 46 are secured to a pontoon along the length thereof. In addition, an enlarged tubular member 48 is located between the linear ribs. The tubular member is for receiving the inboard ends 50 of the ribs and sliding relationship therewith.

Securement in one position or the other is effected through quick release pins 54. Such pins extend through apertures 56 in the ribs and aligned apertures 58 in the sleeve. The quick release pins function to lock the ribs with respect to the adjustment sleeve in a predetermined orientation. Such as to define the spacing between pontoons.

Drive means 62 are provided for automatically moving the rib into and out of the adjustment sleeve in equal and opposite directions. Such adjustment mechanisms include a jack screw 64. The jack screw has oppositely disposed threads 66 and 68 on each side of the midpoint of the jack screw. The threads are cooperable with threaded apertures 70 at the inboard ends of the ribs. In this manner, rotation of the jack screw in one direction will retract the ribs to reduce the width of a pontoon by about fifty percent. Rotation in the opposite direction will act to expand the spacing between the pontoons to a full spacing of about one hundred percent.

The drive means also includes a motor 74. The motor is coupled to the adjustment sleeve at its central extent. The motor has a drive shaft 76 with bevel gears 78 and 80. The motor shaft and gears are operable to automatically rotate the jack screw in one direction and the other under the control of an operator through conventional controls not shown.

The last component of the system is a stop member 84 on each outboard end 86 of the jack screw. Such stop member is cooperable with an abutment surface 88 located interior of each rib. Together the abutment surface and stop member function to limit the inboard motion of the ribs.

The present invention is a flotation device with adjustable spreaders to enable the width of a twin hulled vessel to be increased. As stored in or on a vehicle, the vessel can be narrow in width. When used in the water, with little effort, the width can be doubled. A boat which is only 6 feet across, can be increased to approximately 12 feet, by making simple adjustments. The load carrying area of the vessel is also doubled. This is performed without changing the pontoons in any way and with minimal changes in the construction of the boat.

The spreaders are made of the square aluminum tubing which is made in two sections. These sections slide telescopically into the ends of a coupling which is positioned between them. When the spreaders are in the retracted position, and the tubing is inside of the coupling, the sections are only 6 feet long. In the maximum position, the tubing extends out 3 feet on each side of the coupling. This enables the spreader to extend out 12 feet in length. They can be locked in that position with pins, as well as in the retracted or other intermediate locations.

To assist in spreading and retracting the pontoons, two of the spreaders can be equipped with self contained and waterproof geared motorized mechanisms. At the press of a button each can increase or decrease the width between the pontoons. The unlocked unmotorized spreaders are allowed to lengthen or shorten to suit the width, and are then locked in place.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved pontoon device with mechanisms for varying the width comprising, in combination:

a floor having an upper surface and a lower surface with parallel side edges and parallel front and rear edges, the floor being centrally split parallel with the side edges to define two similar sections between the side edges with hinges along the center line pivotally coupling the two similar sections;

pontoons positionable with respect to the floor with the axes of the pontoons parallel with the side edges of the floor and located beneath the side edges thereof;

handrails coupled to and extending upwardly from the upper surface of the floor parallel with the pontoons and side edges;

adjustment mechanisms to vary the lateral spacing between the pontoons, such adjustment mechanisms including a plurality of rod assemblies, parallel with respect to each other, and secured at their opposite ends to the pontoons beneath the lower surface of the floor, each rod assembly including a pair of small linear ribs in axial alignment with their outboard ends secured to a pontoon and with an enlarged tubular member therebetween receiving the inboard ends of the ribs in sliding relationship therewith;

quick release pins extendable through apertures in the plurality of ribs and the plurality of adjustment tubular members to lock the ribs with respect to the adjustment tubular members in a predetermined orientation to define the spacing between the pontoons;

drive means for automatically moving the ribs into and out of the adjustment tubular member, such adjustment mechanisms including a single jack screw with oppositely disposed threads on each side of the midpoint cooperable with threaded apertures at the inboard end of the ribs, whereby rotation of the jack screw in one direction will retract the ribs to reduce an initial spacing between the pontoons by about 50 percent while rotation in the other direction will act to expand the spacing between the pontoons to about 100 percent of the reduced spacing, the drive means also including a motor coupled to the adjustment tubular member with bevel gears operable to automatically rotate the jack screw in one direction and the other; and a stop member on the outboard end of the jack screw cooperable with an abutment surface interior of the ribs to limit the inboard motion of the ribs.

* * * * *